United States Patent [19]

Serbousek

[11] Patent Number: 5,076,704

[45] Date of Patent: Dec. 31, 1991

[54] METHODS OF AND APPARATUS FOR BLENDING AND ELEVATING MATERIALS

[75] Inventor: Richard D. Serbousek, Swisher, Iowa

[73] Assignee: Highway Equipment Company, Cedar Rapids, Iowa

[21] Appl. No.: 652,570

[22] Filed: Feb. 8, 1991

[51] Int. Cl.[5] ..... B01F 15/04; B01F 15/02; B01F 9/02

[52] U.S. Cl. ..... 366/141; 198/370; 198/658; 366/187; 366/228

[58] Field of Search ..... 366/228, 220, 226, 227, 366/229, 233, 54, 57, 59, 62, 18, 17, 141, 187, 188; 198/370, 658

[56] References Cited

U.S. PATENT DOCUMENTS

| | | | |
|---|---|---|---|
| 1,354,326 | 11/1920 | Moore . | |
| 2,080,508 | 5/1937 | Sackett . | |
| 2,254,639 | 11/1941 | Andrae . | |
| 2,665,796 | 1/1954 | Anderson | 198/658 |
| 3,279,592 | 10/1966 | Kerkvliet | 198/370 |
| 3,612,490 | 6/1969 | Bopp et al. . | |
| 4,350,444 | 9/1982 | Yargus et al. . | |
| 4,543,180 | 9/1985 | Riker | 366/228 |
| 4,660,987 | 4/1987 | Robinson . | |

*Primary Examiner*—Robert W. Jenkins

*Attorney, Agent, or Firm*—Simmons, Perrine, Albright & Ellwood

[57] ABSTRACT

A material blender includes an inclined, axially rotatable drum which is capable of executing multiple functions related to blending of materials including weighing and conveying the materials. The materials, such as agricultural fertilizers are loaded at a lower end into the drum and are at the same time weighted by weigh cells supporting the apparatus. The materials are then conveyed in an annular space of the drum to an upper end of the drum. An end cover disposed at the upper end of the drum is selectively movable between an open and a closed position. When the end cover is in the closed position the materials are transferred at the upper end from the annular space to a central return tube from where they are distributed and blended with parcels of material moving in turn toward the upper end to also be so distributed. Upon completion of the blending process, the end cover is moved away from the drum enabling the drum to discharge the blended materials directly through a discharge chute to a bin or vehicle, thereby eliminating a transfer of blended materials to a separate transfer conveyor.

19 Claims, 3 Drawing Sheets

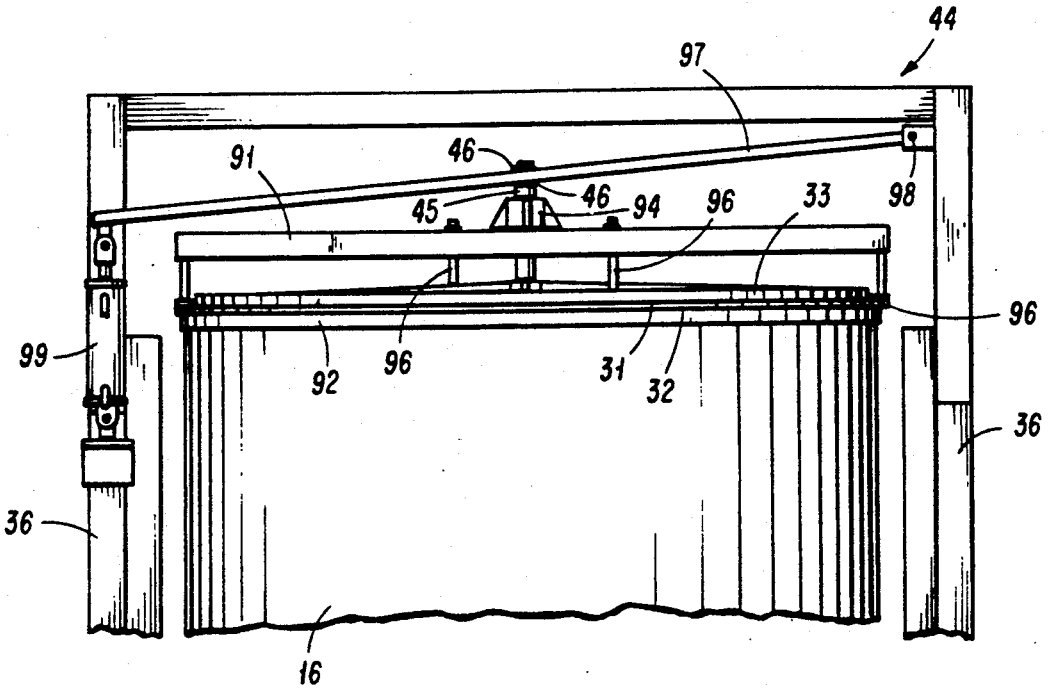
FIG. 5
FIG. 6
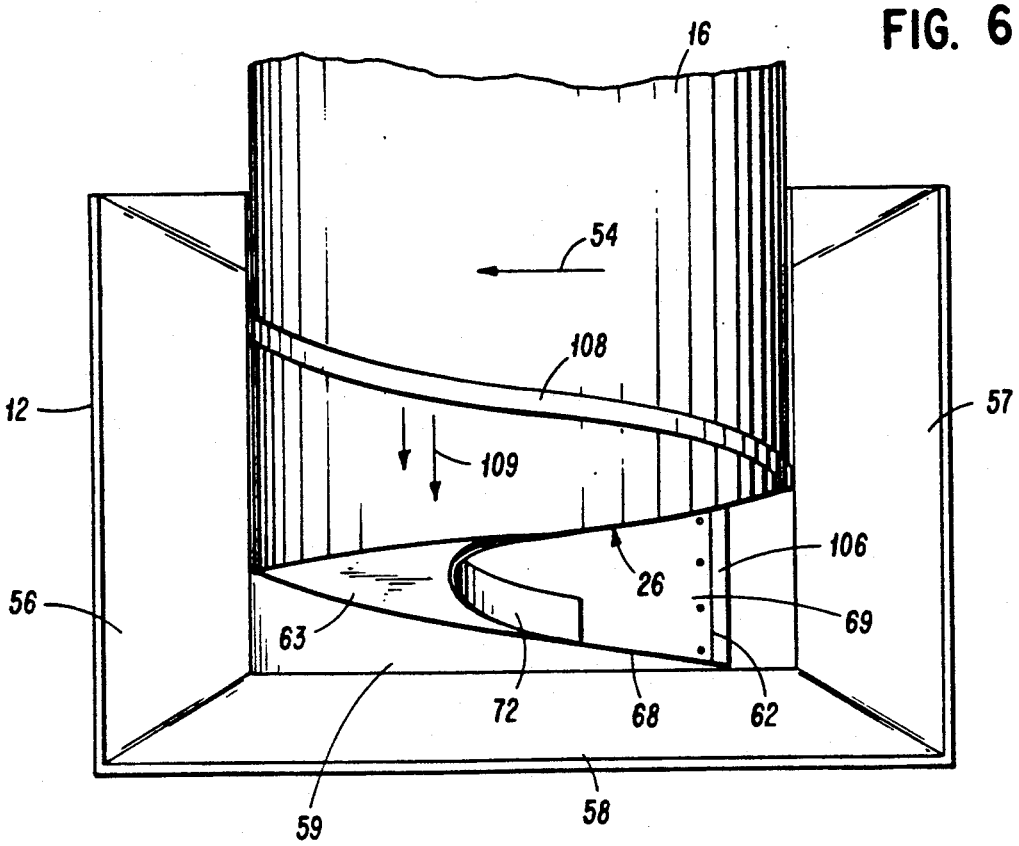

METHODS OF AND APPARATUS FOR BLENDING AND ELEVATING MATERIALS

BACKGROUND OF THE INVENTION

1. Field of the Invention

The invention relates generally to methods of and apparatus for blending materials and more particularly the invention relates to blending bulk materials including granular materials and to conveying such materials.

2. Discussion of the Art

Blenders used for processing bulk materials including such granular materials as animal feeds, chemical fertilizers or the like typically include apparatus for loading or charging the materials into the blenders, a blending or mixing chamber to perform the actual blending function, and further handling provisions. For example a conveyor may receive blended materials after their discharge from the blender or the materials may be fed through chutes into bagging operations. In many commercial bulk mixing operations the blended product, if not bagged, may be discharge into storage bins or discharged onto a vehicle to be transported to its intended place of use. Discharge conveyors, consequently may lift the blended product to substantial discharge heights, particularly when the blended materials are discharged by gravity into holding bins or into vehicle hoppers.

In all blending operations, blending efficiency and capacity are basic desired attributes. Most batch blenders are built to a predetermined size in terms of the largest batch of materials that can be processed at one time. Fertilizer blenders, for example, may be rated in terms of tons of blended material. Such blenders may have capacities of a relatively wide range, two to ten tons of material being within such range. It is of course desirable to blend any quantity of materials up to the maximum capacity of the unit with equal efficiency. Much effort has been exerted over the years to provide more efficient blenders.

Blenders which use rotating drums may historically have been the oldest types of blenders. In a blending process with early type blenders, proportioning the materials, such as by weighing them, feeding the materials from a staging hopper, such as a weigh hopper into the blender, blending them within the blender and then discharging and storing them as bulk or in weighed quantities involved separate operations. Later types of blenders sought to combine operations and streamline the blending process.

Vertical auger type blenders, for example, are sometimes referred to as "one-piece" blenders. Nevertheless, typical auger blenders feature independent feed-in power, mixing power, and discharge or unload power. Such independent power trains, though adding to the complexity of the blenders, are needed to satisfy simultaneous material loading power during the early cycle of the mixing process, and power for discharging the blended materials at the end of the mixing process.

Vertical auger type blenders typically feature a hopper with a downwardly conically converging base. A vertically operable auger is disposed centrally in the blending bin. The material becomes blended by being lifted centrally by the auger and by the distributing itself at the top surface of the batch of material in the blending bin. A screw type blender is typically discharged onto a conveyor at the bottom of the bin. Some grinding of the granular materials may take place in the screw conveyor and some separation of the materials may take place in a natural size grading process at the upper surface of the batch being blended. However, a more serious problem which may occur relates to a decrease of the mixing action on materials as their radial distance from the screw conveyor increases. Thus, as a batch size in the blender is increased, the efficiency of such a blender appears to decrease, thereby tending to increase the time required for fully blending a respective batch of the materials.

Other blenders referred to as paddle wheel blenders combine material weighing, hence proportioning, and blending operations to be performed in a single piece of equipment. Paddle wheel blenders provide a blending or mixing action by rotating paddles which extend from a typically horizontally disposed shaft. The rotating paddles are forced into the batch of material to be blended. The blending action becomes more thorough than that of auger type blenders. However, the blending operation also tends to become more power intensive than necessary. Also, a grinding of granular materials should be expected to occur throughout the blending cycle as a result of the paddle wheel action in the proximity of the inner surface of the blending drum.

The above mentioned, conventional rotating drum type blender does not generate such a grinding action within its blending chamber. A rotary drum is disposed to rotate about a substantially horizontal axis. Flights attached to the inside of the drum rotate with the drum and are thus more gentle on the materials therein. The flights lift and drop the materials to achieve the mixing action. On a particular variation of the rotating drum blenders, the axis of rotation of the drum is typically disposed at a slight incline. The drum has helically winding flights on the inside of the drum and a charging and discharging opening disposed at the higher of the two ends. A central opening leads into the drum to load or charge the materials to be blended. An annular inner wall between the central opening and the outer drum enables the helical flights disposed in the annular space between the inner wall and the outer wall to function as a screw type discharge conveyor. Thus, during the mixing process, the drum may be rotated in one direction, such that the annular screw conveyor functions to urge the materials out of the annular region of the drum and toward the mixing region in a main portion of the drum. To discharge the materials from the drum, the rotation of the drum is reversed and the helical flights function as a screw auger to discharge the blended materials from the drum. Since the rotating drum type blenders typically cause little or no grinding action on granular materials, dust levels from ground fines which are typically connected with blending of dry, granular materials are reduced. On the other hand, overmixing may segregate the blended materials according to different particle sizes. To the extent that different constituents may have respectively different average particle sizes, care must be exercised in selecting materials of similar particle size and in supervising the blending process so that the blended quality of the final product is not compromised.

As already suggested from the prior discussion, one of the disadvantages common to all known blenders relates to the relative complexity of the operations of handling and blending the materials. Handling equipment for transferring the blended materials from the blender to transport vehicles or storage bins becomes substantially as complex as the blending apparatus itself.

Subsequent handling of the blended materials causes dust generation and often some small amount of material leakage during the transfer of the material from the blending apparatus to a conveyor. The complexity results from selectively activated conveyors, and from the need to provide housings or shielding for the materials from the elements and for minimizing material leakage and dust generation particularly during transfer processes, such as by conveyors.

Dust generation during the actual mixing process can typically be contained within the substantially enclosed blending chambers or drums. However, to the extent that the materials are fed into the blending chambers and are typically discharged from the blending chambers onto loading conveyors, airborne dust generation during the handling of the materials generally tends to remain a problem. The dust problem may be aggravated when the materials handled are chemicals like fertilizers, and clean air standards require extensive shielding to control the escape of dust.

With respect to blending chemical fertilizers, another problem relates to spillage or leakage of the materials from conveyors while the materials are handled outside of the blending chambers, as during loading and unloading the blender. A spillage can result from a material leakage during the discharge of material from the blending chamber onto a conveyor to transfer the blended material to the transport vehicle. Typically the leakage may be minor, but even then presents a problem when continuous and cumulative. Though conveyors are often encased by housings, loading hoppers at the lower ends of the conveyors typically cannot be totally sealed against conveyor belts to prevent leakage. The materials tend to bounce during acceleration and there may be a certain amount of carry back at the ends of a typical belt conveyor. Any amount of material leakage, however, is undesirable if not unacceptable.

SUMMARY OF THE INVENTION

The present invention addresses problems associated with the discussed state of the art material blenders and simplifies material handling processes. The present invention particularly improves blending of materials and subsequent loading of blended materials onto vehicles.

In accordance with the invention, a blender comprises an elongate cylindrical drum which is mounted for rotation about a central longitudinal axis and is disposed at an incline, such that the drum has a lower and an upper end. Provision is made for the drum to receive material at the lower end of the drum and for advancing the material along an annular space adjacent an inner wall of the drum toward its upper end. A material conduit extends substantially from a first end adjacent the upper end of the drum within the annular space of the drum to a second end intermediate the upper and lower ends of the drum for providing for return movement of the material from the upper end of the drum toward the lower end of the drum. The material conduit including a provision for transferring material between the material conduit and the annular space of the drum.

According to the invention a material blender comprises a single power train for receiving, elevating and blending various constituents of material in a single piece of apparatus between an intake or feed hopper and a discharge end of the apparatus. The elevating and blending operation is accomplished within a single, inclined, rotatably driven elevating and blending drum of the apparatus. The apparatus provides for weighing the constituents of the material to be blended, and elevating the material while blending it. The material is discharged at an upper end of the drum by the continuous rotation of the drum after a discharge door is opened.

Further in accordance with the invention, material is fed into a lower end of an elongate drum which is lengthwise disposed at an incline. The material is blended by advancing the material in an annular space adjacent an inner wall of the drum from the lower end toward an opposite, upper end of the drum, and by returning the material from the upper end of the drum in a direction toward the lower end of the drum in a central space within the annular space of the drum, and by transferring portions of the material at selected points intermediate the upper and lower end of the drum between the central and annular spaces of the drum.

Advantages of the invention include a single power train for performing the elevating and blending action on the material and reduced material spillage and dust generation as a result of the blending and elevating operations.

Various other features and advantages of the invention will become apparent from the detailed description of the invention in reference to a preferred embodiment thereof.

BRIEF DESCRIPTION OF THE DRAWINGS

The invention and the description of a particular embodiment thereof will be best understood when the Detailed Description below is read in reference to the appended drawings wherein:

FIG. 5 is a more detailed view of a particular embodiment of a discharge end of the drum and an end cover and mechanism; and FIG. 6 is a plan view of an intake hopper of the blending apparatus.

DETAILED DESCRIPTION OF THE INVENTION

Figure 1:
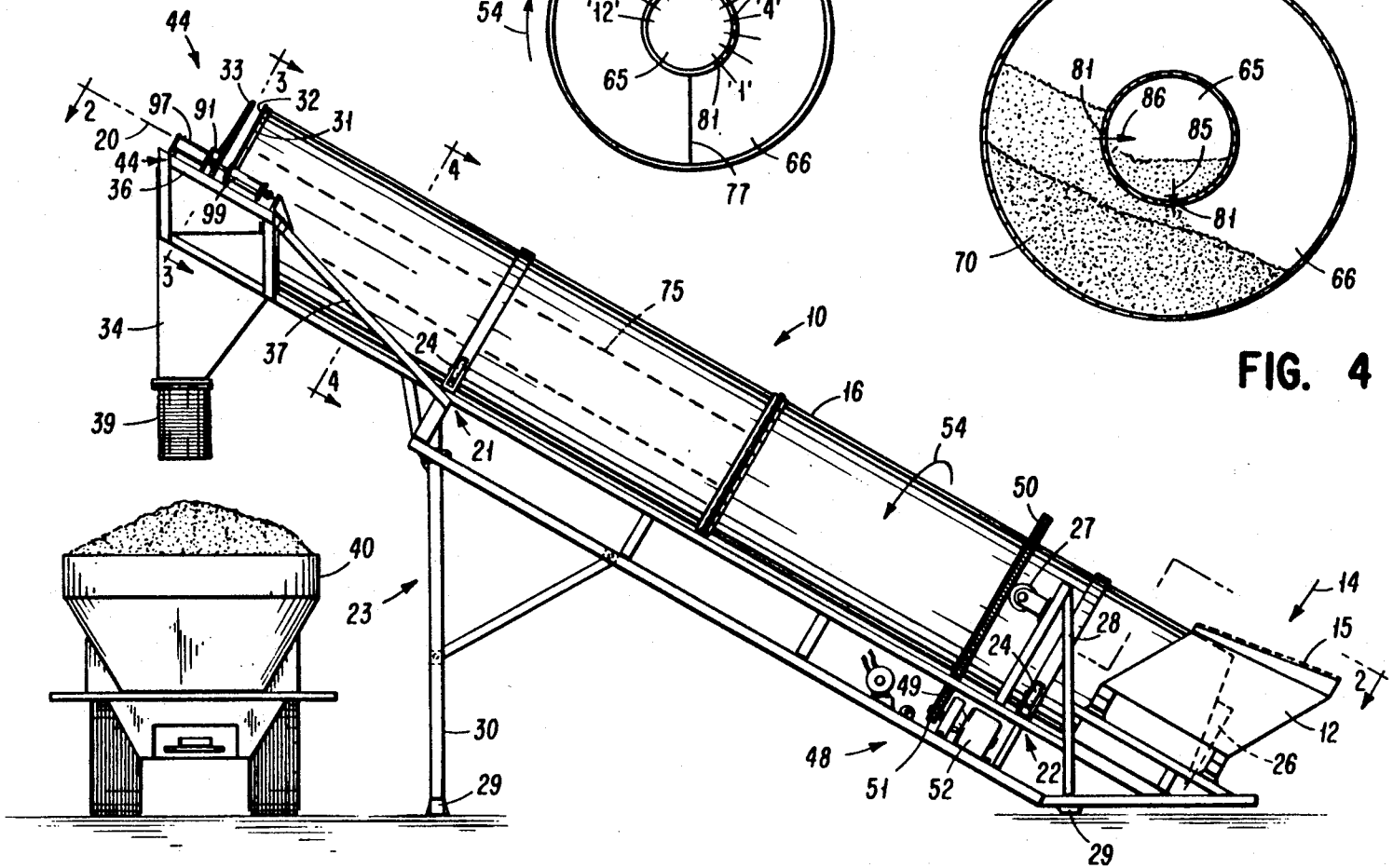
FIG. 1 shows a somewhat simplified side elevation of an elevating and blending apparatus as a particular embodiment of the invention.

Referring now to FIG. 1, there is shown apparatus which is designated generally by the numeral 10. As will become apparent, the apparatus 10 may be operated to elevate and blend materials charged or loaded into an intake or feed hopper 12 as indicated at arrow 14. The materials 14 are loaded into the hopper 12 through a screen 15. The screen separates extraneous materials of a size which may interfere with the blending action and also serves as a safety screen to prevent operators of the apparatus 10 from injury due to contact with moving elements at the intake hopper 12. The materials 14 are advantageously elevated and blended within an elongate, cylindrical drum 16. The drum 16 is in its operating position disposed at an incline and at a substantial angle with respect to the horizontal. The precise angle of the incline is, of course, one of preference in that the apparatus 10 may be operated over a range of elevational angles with respect to the horizontal. At smaller angles the length of the drum 16 would need to be increased to elevate the materials to a minimum desired height. Also, as may become apparent, the discharge forces at the upper end may be undesirably large at lower angles. A desirable range of elevations for the drum 16 may be chosen with preferred elevations ranging, as an example only, between 23 to 28 degrees. Thus, the described apparatus 10 is expected to operate with an elevation of the drum 16 at 25 degrees within such a preferred range of values. However, from the following description it will become apparent that other angles may be preferred and modifications may be made to the apparatus 10 to gain advantages of the invention at angles of elevation of the drum 16 other than the currently preferred 25 degrees.

The drum 16 is in the preferred embodiment of circular cross section about a central longitudinal axis 20. The drum 16 is mounted on sets of upper and lower support wheels shown at 21 and 22, respectively, to rotate about its central longitudinal axis 20. The sets of wheels 21 and 22 are mounted on a support frame designated generally by the numeral 23. Each of the sets 21 and 22 comprises preferably two support wheels 24 disposed laterally spaced in a plane transverse to the longitudinal axis 20. The two wheels 24 in each respective set thus cradle the drum 16 in such transverse plane. The support wheels 24 may be non-flanged, since the wheels 24 desirably support the drum 16 only in the aforementioned transverse plane. End thrust forces, such forces urging the drum 16 toward a lower end 26 of the drum as a result of its inclined orientation, are opposed by sets of end thrust rollers 27. In a preferred embodiment at least two rollers 27 in diametrically opposite positions, are mounted to a lower support structure 28 of the support frame 23. The end thrust rollers 27 interact with the support wheels 24 and cradle the drum 16 in its longitudinal direction. Though the position of the drum is fixed with respect to the support frame 23 by resting within respective cradles formed by the described sets of rollers, the drum 16 is at the same time free to rotate about its axis 20 within the support frame 23. The entire weight of the apparatus 10 is supported by the support frame 23. A three point suspension of the support frame 23 includes three weigh cells 29. Two of the weigh cells 29 are laterally spaced at a forward end 30 of the support frame 23. A third weigh cell 29 is disposed beneath the hopper 12 at the lower end of the apparatus 10. Cumulative indications may be read from all three weigh cells 29 in combination, allowing an empty weight of the apparatus to be used as a datum before materials are loaded into the hopper 12. A difference between a prior reading and a new reading permits a determination of the amount of material loaded into the hopper 12 between two readings. By such determination the correct proportions of constituent materials are determined. It may further be implemented to determine from the front to rear distribution of the load on the weigh cells 29 the status of the distribution of materials within the drum 16. Such indications may be used to determine optimum time intervals for blending materials.

Opposite the lower end or intake end 26 of the drum 16 is an upper end or discharge end 31. A circular end face opening 32 of the cylindrical drum 16 is covered in the preferred embodiment by an end cover 33. The end cover 33 is axially movable between a spaced or open position as shown in FIG. 1, and a closed position in which the cover rests in contact with the upper end 31 of the drum 16. Other structures may be devised for selectively opening and closing the end face opening 32 of the drum 16 within the scope of the invention. A lid may be pivotally mounted, for example. However, the disclosed, axially movable circular end cover or door 33 is preferred.

A discharge chute 34 is mounted to an upper support structure 36 including braces 37 to support the discharge chute 34 in proximity to the drum 16. A tubular discharge chute extension 39 may be used to guide materials discharged at the upper end 31 into a vehicle 40 or bin (not shown). As indicated, a length by which the discharge chute extension depends below the chute 34 may be varied as desired if such an extension 39 is used in accordance herewith.

The upper support structure 36 also supports, together with the discharge chute 34, an axially operable drive structure or drive mechanism 44 for selectively moving the end cover 33 away from or into engagement with the circular end face 32 of the drum to respectively open or seal the discharge end of the drum. The drive mechanism 44 may be driven electrically, hydraulically, mechanically or pneumatically. For example, activation may be by a well known lead screw drive, or the door end cover may be moved by a hydraulic cylinder (a preferred drive mechanism being shown in FIG. 5) if so desired. A central support rod 45 disposed along the longitudinal axis 20 may rotate with respect to a thrust bearing 46, the support rod 45 supporting the end cover 33 for rotation along with the drum 16 during the operation of the apparatus 10.

Figure 2:
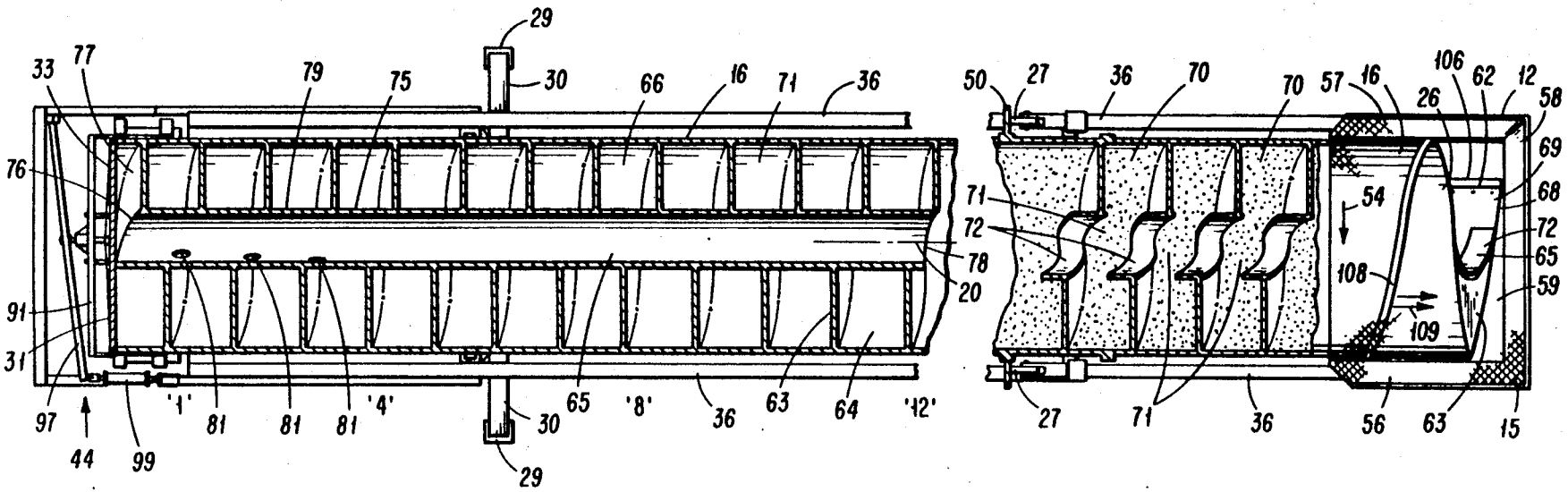
FIG. 2 is a sectional top view of a drum of the apparatus shown in FIG. 1, as taken along the lines "2—2" in FIG. 1, and showing a central return chute as a preferred embodiment of a particular feature of the invention.

In operation, the drum 16 is rotated about its longitudinal axis 20 by an externally mounted drive mechanism 48. The drive mechanism may in a preferred embodiment include a drive chain 49 engaging the drum 16 via a circumferentially mounted chain drive gear 50 and typically driven through drive sprockets 51 by an industrial type drive including a typical combination of a speed reducer and electric motor 52 mounted to the lower support s structure 28. With the electric motor 52 operating for example at 1750 RPM, the rotational speed of the drum may be, as an example, 15 RPM. Optionally, the drum 16 may be driven by such other power sources as may be desired, including conventional gasoline engines. The direction of rotation of the drum 16, though initially of choice, becomes fixed by the design of the drum. A preferred direction of rotation may be, for example, as indicated by arrow 54, hence counterclockwise when viewing the drum 16 from its lower end 26. During the operation of the apparatus 10, the drum 16 performs a dual function of both elevating materials charged into the hopper 12 from the lower end 26 to the upper discharge end 31 and blending the materials while the materials are being moved about within the interior space of the drum 16. The function of elevating and blending the materials may be best understood in reference to FIGS. 2 and 3 of the drawings. FIG. 2 of the drawings shows a simplified longitudinal section view of the drum 16, some of the identically recurring features having been deleted from the illustration.

Figure 4:
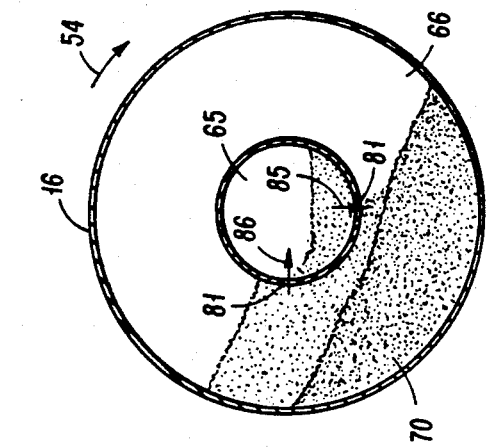
FIG. 4 is a simplified schematic axial sectional view of the drum, substantially along "4—4" in FIG. 1, to illustrate a material transfer function through a mixing aperture of the drum.

In reference to FIG. 2, the lower end 26 of the drum 16 is disposed within the intake hopper 12. Preferably, hopper side walls 56 and 57 and a hopper end wall 58 converge toward a semi-cylindrical hopper bottom 59. The diameter of the hopper bottom 59 preferably exceeds the outer diameter of the drum 16 by only a nominal amount for clearance purposes, such that the drum 16 fits rotatably just inside the hopper bottom 59. The lower end 26 of the drum 16 is convoluted and features an intake edge 62 which preferably extends parallel to the longitudinal axis 20 of the drum 16. The length of the edge 62 may be equal to the pitch or first helix of a helical wall 63 which extends radially inward from an inner surface 64 of the drum 16 toward the central axis. The height of the wall 63 is less than the inner radius of the drum 16, such that a cylindrical space 65 (see FIG. 3) centered on the longitudinal axis 20 remains unobstructed or open throughout the entire length of the drum 16. Conversely, the helical wall 63 occupies an annular space 66 along the inner wall 64 of the drum 16. Preferably, the helical wall 63 extends with constant pitch from the lower end 26 of drum 16 to its upper discharge end 31, except that the helical pitch may be greater in a first helical turn to facilitate scooping of materials from the hopper 12. Trailing wall portions with respect to the direction of rotation as indicated by the arrow 54 (FIG. 2) are axially displaced toward the upper end 31 of the drum 16. As the drum 16 rotates in the predetermined direction, the intake edge 62 advances adjacent the hopper bottom 59 to scoop up the materials disposed in the hopper 12. The advancing opening or area defined by the leading edge 62, by a leading edge 68 of the wall 63, and by the adjacent next helix of the wall 63 constitute a material intake port 69 of the drum 16. During each revolution of the drum 16 the scooped up material is advanced by one space between two adjacent helixes of the wall 63. Also, in each revolution of the drum 16, a new parcel 70 (see also FIG. 4) of material is scooped up by the port 69, each of the parcels 70 being discrete parcels of material. Of course it is to be understood that some of the material of the parcels, while the parcels are being advanced in the bottom of adjacent helical turns of the wall 63 toward the upper end 31 becomes mixed with material from adjacent parcels by typical spill over. This is expected and is part of the blending process. In general the parcels advance with the rotation of the drum 16 as adjacent parcels 70 of material within the annular space of the drum 16 toward the upper discharge end 31. Thus, the helical wall 63 functions as a spacer between adjacent ones of the parcels 70 and forms a plurality of axially displaced pockets 71 for holding, advancing and blending a certain amount of the material which makes up each parcel 70. If the material which has accumulated in the hopper bottom 59 exceeds the capacity of a scooping turn of the drum 16, the excess material may spill over the wall 63 and fall back through the cylindrical, central opening 65 at the end of the drum 16 into the hopper 12. Similarly, if the material in any one of the pockets 71 exceeds the material capacity of the pocket, the material flows over the inner edge of the wall 63 back to the next lower pocket 71.

As the drum 16 rotates, each scooped up parcel 70 of material remains substantially in a lower portion of the drum 16. However, the material tends to remain stationary in contact with the inner surface 64 of the drum 16. As the drum 16 rotates, the inner wall 64 is advanced into an increasingly steeper orientation. At a certain point, the material ultimately falls back into the lower portions of the drum 16. The resulting tumbling motion of the material in each parcel 70 continues to blend the material as each parcel 70 of material advances axially within the annular space 66 toward the upper end of the drum 16. The material holding capacity of each helically spaced pocket 71 may be increased by a cap 72 which is attached to and extends across the inner edge of the wall 63. The cap 72 may close off, for example, about one third of existing space between two adjacent helixes of the wall 63, the remaining spaces between adjacent helixes of the cap 72 providing for spill-over communication between adjacent ones of the material pockets 71 and causing further blending action among the material within the drum 16.

In the upper half of the drum 16, a central cylindrical conduit, duct or tube 75 is inserted into the central cylindrical space 65 encompassed by the annular region or space 66. At an upper end 76 the tube 75 is attached to an uppermost convolution 77 of the wall 63. Being of substantial length, a lower end 78 of the tube 75 preferably lies at about the midpoint between the respective ends of the drum 16. The outer diameter of the tube 75 is equal to the diameter of the cylindrical space 65, such that an outer wall surface 79 lies in contact with the inner edge of the wall 63.

With the end cover 33 being closed against the circular end face 32 of the drum 16, material being advanced in the pockets 71 to the upper end 31 are urged from the rotationally decreasing annular space between the uppermost convolution 77 of the wall 63 and the end cover 33 into the central tube 75. Consequently, the uppermost convolution 77 in conjunction with the end cover 33 an ever decreasing space to the material, as the drum 16 continues to rotate. The blocking end cover 33 consequently functions to transfer the material from the annular space 66 to the central space 65 within the tube 75. The tube 75 provides a return path for the elevated materials and guides the transferred materials in their flow downward toward the lower end of the drum 16. Generally the material return path through the tube 75 is gravity induced or fed. However, feed assist provisions, such as pneumatic or mechanical assist provisions are considered to be within the scope of the invention. Once transferred from the annular space or region 66 to the central tube 75, the materials slide toward the lower end 78. Along this return path, the materials encounter a series of mixing apertures 81 which are disposed at predetermined intervals and angular positions along the entire length of the tube 75. As illustrated in FIG. 2, the mixing apertures 81 are preferably disposed to locate one of the apertures 81 in each helical space between the upper and lower ends 76 and 78 of the tube 75. Also, the mixing apertures are advantageously located next to and immediately below an upper one of two adjacent convolutions of the wall 63. A first and uppermost one of the mixing apertures 81 is disposed to move into the material as the material is transferred by the rotation of the drum 16 from the annular pockets 71 to the central tube 75.

Figure 3:
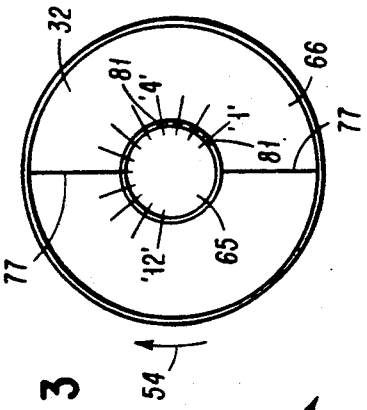
FIG. 3 is a simplified end view of the drum taken in the direction "3—3" in FIG. 1.

In the preferred embodiment each successive downstream (with respect to the flow of material in the tube 75) mixing aperture 81 lags a previous, upstream one by an angle with respect to the direction of rotation which allows successive apertures to rotate into the flow of material as a particular parcel of material is unloaded at the upper end into the drum and advances downward. The preferred angle in the described embodiment is in the order of twenty degrees, as may be seen best in reference to both FIGS. 2 and 3. It should be understood that the referred to lag angle may vary with the pitch of the helical wall 63 and with the preferred design angle of the drum 16 with respect to the horizontal. In FIG. 3, twelve angular positions are shown and three representative angular positions of the apertures 81 are indicated in FIG. 3 as "1", "4" and "12" with axial positions thereof similarly shown in FIG. 2. It has been determined that for an incline of the preferred 25 degrees, the rate at which the material moves through the tube 75 allows each successive mixing aperture 81 to turn into the returning parcel of material. Consequently, the material from any one pocket 71, once the pocket of material has been elevated to the upper end of 31 of the drum 16 and is transferred to the central tube 75 is divided and becomes distributed among the other pockets 71 of material advancing in the annular space 61 about the tube 75. Thus, within the region of the tube 75 blending or mixing of material occurs, other than by mere spill-over transfer from an upper pocket of material to an adjacent lower pocket 71. The described distributive blending action is further enhanced by a secondary transfer of material that has been noted to occur from the annular space 66 to the tube 75. Initially as an entire parcel 70 of material is transferred during each revolution of the drum 16 at the upper end from the annular space 66 to the mixing tube 75, the material moves downward along the tube 75. The mixing apertures 81 turn into the parcel of material as it proceeds along the tube 75. Since the apertures 81 are located just downstream of an upper convolution of the wall 63, the material in the pocket 71 is disposed against the lower convolution and material is transferred from the central tube 75 to the annular space 66 to be added to and blended with the material in the respective pocket 71. In reference to FIG. 4, such initial transfer of material through a lowermost position of the mixing aperture 81 is indicated by arrow 85. However, as the drum 16 continues to rotate, the aperture 81 advances angularly toward the region of the drum 1 in which material tends to tumble back toward the bottom of the pocket 71. At the same time, the helix angle of the wall 63 has elevated the material in the pocket 71 along the axis 20, and hence with respect to the position of the aperture 81. Thus, as the aperture 81 is rotated to an advanced lateral position along the tube 75, material begins to transfer back from the annular space 66 into the central tube 75, as indicated by arrow 86. The apertures 81 consequently provide for an exchange of material, first, from the tube 75 to the peripheral space of the drum 16, but also from the peripheral space back to the interior of the tube 75

As described above, the blending action of the described apparatus 10 includes the tumbling blending action of material within each respective pocket 71. Distributive blending of materials is provided as a parcel of material is transferred during each revolution of the drum 16 at the upper end 31 from the annular space 66 to the tube 75. The transferred material is distributed from the tube to most, if not all, of the pockets 71 of material advancing in the annular space about the tube 75 toward the upper end of the drum 16. Further blending action is provided by material from the annular pockets 71 re-entering the tube 75 and moving from there to either another, lower aperture 81 to mix with another pocket of material, or to return to the lower end 78 of the tube 75 to become an initial amount of material in such lowermost pocket 71 entering the blending region of the tube 75. On each revolution, the amount of material is such pocket 71 tends to increase, in that on each revolution of the drum 16 some of the returning material in the tube 75 will pass through the respective aperture 81 to blend with the material already in the pocket 71. Thus it should be understood, that the quantity of material in each of the pockets 71 tends to increase as the respective pockets 71 move closer to the upper end 31 of the drum 16 until the exchange of material becomes equal in both directions out of and into the tube 75. Blending action continues as the end cover remains in the closed position pressed against the circular end face 32 of the drum 16.

The described blending action occurs consequently by several different blending processes. Some blending may occur through the apertures 81 adjacent the upper end 31 of the drum 16. Further blending occurs when some of the material is returned to the lower end of the tube 75 to occupy an available pocket between adjacent helixes of the wall 63. This latter type blending involves spill-over blending between adjacent pockets 71 as well as blending action because of the tumbling motion within each of the pockets 71. Upon initially loading the materials into the hopper 12, the materials are elevated in the described manner to the upper end 31 of the drum 16. At the upper end the materials are transferred from the annular space of the drum 16 to the central return tube 75 from which they mix with the materials in each of the pockets 71 as described. It is believed that advancing the material as parcels of material within the pockets 71 results in a reduction of separation of material according to particle size, as it may occur in prior art drum blenders. Blending of smaller quantities of material will result in each of the pockets 71 carrying less material, while larger quantities will tend to cause more of the lowermost pockets 71 to become engaged in the blending process with an increased amount of spill-over blending, and more material may also be contained in each of the pockets 71.

Upon completion of the blending action, the end cover is moved away from the end face 32 at the upper end 31 of the drum 16. The open end allows the material elevated to the upper end 31 to enter the discharge chute 34 instead of being transferred to the central tube 75. When the end cover 33 is moved away from the end face, the transfer of material by interaction between the helical wall and the end cover becomes disabled. The material, already for the most part in the annular space 66 in the upper portion of the drum 16 is then quickly discharged from the drum 16 directly through the discharge chute 34 to a receiving bin or vehicle 40.

The described interactions are not at all limited to a particular size of apparatus, though certain applications of a combined elevating and blending apparatus such as that described may favor a certain size, while another application may favor a completely different size of apparatus, all within the spirit and scope of the invention. A particular apparatus which may be used to blend chemical fertilizers in commercial applications may feature, for example a drum 16 which has an overall diameter of 66 inches and which has a preferred corresponding axial length of 33 feet. At the preferred incline of 25 degrees, the discharge end may be disposed at a height of about 12 feet, such that the blended and elevated materials may be discharged directly into a vehicle without material transfer to an intermediate conveyor, thereby minimizing dust and spillage.

In the referred to drum 16 of 33 feet of length the wall may have a preferred radial height of approximately two feet, the central tube 75 being substantially 16 inches in diameter. A preferred pitch of the helix is also 16 inches, such that the pockets 71 have an axial width of 16 inches. This preferred pitch translates to a preferred fertilizer blending capacity of a nominal ten tons. It is contemplated to vary the pitch of the helical wall 63 within the drum 16 to arrive at different design capacities for the blending apparatus 10 without external changes. Thus a change of the described pitch to a 22 inch pitch would axially space the pockets 71 and decrease the capacity of the blender to approximately eight tons.

To advance the parcels 70 through the drum 16, more than a single helical wall 63 may of course be used. Using for example, two interleaved helical walls 63, equally spaced with two intake ports at the lower end of the drum 16 and corresponding two diametrically opposite uppermost convolutions 77, as shown as a specific example in FIG. 3, the number of pockets and the capacity for any given helical pitch can be increased. Material is then received by the drum 16 on every one half revolution. Likewise, the number of parcels of material returning through the tube 75 per revolution of the drum 16 become doubled. The described preferred embodiment of the blending apparatus 10 does, however include a single helical wall 63 as previously described, rather than the referred to alternate double or multiple helical wall structure.

A preferred length of the tube 75 in the described fertilizer blending apparatus 10 may be sixteen feet, thus approximately one half of the overall length of the drum 16. The preferred length of the tube 75 extends, consequently, at the pitch of 16 inches over 12 convolutions of the helical wall 63. Consequently, there may be twelve of the mixing apertures 81 shown in FIG. 3, for example. The mixing apertures 81 disposed along the length of the tube 75 are preferably and for convenience circular apertures, three inches in diameter. Of course, the aperture dimensions, the number of apertures and the trailing angle of twenty degrees in the spacing of adjacent ones of the mixing apertures 81 are chosen based on tests and judgment. It should therefore be kept in mind that the apertures have the function of distributing material from the tube 75 to the plurality of parcels of material advancing within the annular space of the drum 16. Other means to affect such distribution may be devised and even the apertures may be of different size. Such distribution or transfer means may be shaped to alter the guided flow of the returning material within the tube, for example.

FIG. 5 shows the upper discharge end 31 of the drum 16 and shows a particular embodiment for activating the end cover 33 to move toward and away from the end face opening 32 of the drum. A support bridge 91 for the end cover 33 is preferably mounted to an end flange 92 forming an end face of the drum 16. The support bridge 91 consequently rotates with the drum 16. Centrally of the support bridge 91 is a slider bushing assembly 94. Spaced keeper rods 96 extend from the end cover 33 through the bridge 91 and are slidably retained within the bridge 91. The keeper rods 96 maintain the orientation of the end cover 33 with respect to the support bridge 91. A thrust lever 97 extends between laterally opposite members of the upper support structure 36. The thrust bearings 46 rotatably retain the support rod 45 longitudinally with respect to the thrust lever 97. The thrust lever 97 is pivotally attached to one side of the support structure 36 by a pivot mount 98. On the other side of the support structure 36 the thrust lever 97 is attached to a linear activator, such as to a hydraulic cylinder and piston assembly 99. It is to be understood that there are available various types of linear activators. Pneumatic, electric, hydraulic or mechanical activators 99 may serve to pivotally move the one end of the thrust lever 97.

FIG. 6 shows a top view of the lower end or intake end 26 of the drum 16. The leading edge 62 of the intake port 69 of the drum 16 shows a scraper edge 106 attached to the outer surface of the drum 16 along the leading edge 62. The scraper edge moves between the outer surface of the drum and the semi-cylindrical hopper bottom 59 and guides the material within the hopper into the intake port of the drum 16. A simple, yet effective bearing strip 108 is applied in a reverse helical orientation on the outside surface of the drum 16. The bearing strip 108 is of a wear resistant, low friction plastic material, such as "ultra high molecular weight polyethylene". The bearing strip 108, functions as a spacer between the lower end 26 of the drum 16 and the hopper bottom 59. The lower end 26 consequently rests, rotatably supported on the bearing strip 108, on the semi-cylindrical hopper bottom 59. With the bearing strip 108 wrapped about the drum 16 in the helical direction opposite to the helical direction of the helical wall 63, the rotation of the drum 16 in the direction of the arrow 54, the strip 108 consequently has a another function. The bearing strip 108 tends to wipe any material which may seep between the drum 16 and the hopper bottom 59 in the axial direction toward the end of the drum 16. At the end of the drum 16 the material is then scooped up by the leading edge 62. The bearing strip 108 consequently functions as a seal between the hopper 12 and the lower end 26 of the drum 16.

Having described the invention, it should be understood that within the scope of the disclosure, many changes and modifications in the structure of the described embodiment are possible without departing from the spirit and scope of the invention as described herein. The references to any particular structure or even dimensions ar therefore not intended to be limiting to the scope of the invention but are given only as an example for a better understanding of the invention.

What is claimed is:

1. A blender comprising:

an elongate cylindrical drum disposed with a longitudinal axis at an incline, the drum having a material intake end at lower end and a material discharge end at an upper end;

means for receiving material at the lower end of the drum;

means disposed in an annular space adjacent the inner wall and substantially along the length of the drum for advancing the received material along the annular space from the lower end toward its upper end;

power means for driving the advancing means in rotation about the longitudinal axis of the drum;

a material conduit means, extending substantially from a first end adjacent the upper end of the drum and within the annular space of the drum to a second end intermediate the upper and lower ends of the drum, for providing a material flow path from the upper end of the drum to such second end intermediate the upper and lower ends of the drum;

means for transferring material at the upper end of the drum from the annular space to the material conduit means;

means disposed along the material conduit for exchanging material between material flowing from the upper end of the drum through the material conduit means toward said second end of the conduit means and material advancing within the annular space toward the upper end of the drum; and means, selectively activatable, for disabling the transfer means and for discharging the material from the annular space the drum at the upper end of the drum.

2. The blender according to claim 1 wherein the drum is rotatably mounted to rotate about said longitudinal axis, the power means including means for rotating the drum about the longitudinal axis thereof, thereby driving the means for advancing the received materials, and wherein the means for advancing the received material comprises at least one helical wall disposed within an annular space adjacent the inner surface of the drum, said at least one helical wall forming adjacent material pockets for advancing material upon rotation of the drum in adjacent parcels toward the upper end of the drum.

3. The blender according to claim 2, wherein the at least one helical wall is a single helical wall, the means for receiving material at the lower end of the drum is a material receiving hopper having a semi-cylindrical bottom for rotatably retaining the lower end of drum, the lower end of the drum having an intake port formed between an edge of the drum, a leading edge of the helical wall and a first full helix of the wall.

4. The blender according to claim 1 wherein the drum is rotatably mounted to rotate about said longitudinal axis, the power means including means for rotating the drum about the longitudinal axis thereof, thereby driving the means for advancing the received materials, wherein the means for advancing the received material comprises helical wall means attached interiorly of the drum and extending the length of the drum and having a pitch with respect to a predetermined direction of rotation of the drum for advancing the received materials toward the upper end of the drum, and wherein the means for receiving material at the lower end of the drum is a material receiving hopper having a semi-cylindrical bottom for rotatably receiving the lower end of the drum, the lower end of the drum including bearing means disposed adjacent lower end at the outer surface of the drum for rotatably supporting the lower end of the drum against the semi-circular bottom of the hopper.

5. The blender according to claim 4, wherein the bearing means comprises a bearing strip of wear resistant material disposed about the lower end of the drum in a helix having a pitch opposite to the pitch of the helical wall means for urging material disposed between the drum and the semi-cylindrical hopper bottom in a direction away from the upper end of the drum upon rotation of the drum in the predetermined direction.

6. The blender according to claim 1 wherein the means for transferring material at the upper end of the drum from the annular space to the material conduit means comprises an end cover closing off the upper end of the drum and urging materials into the material conduit means, and wherein the material transfer disabling and material discharge means comprises means for moving said end cover away from the upper end of the drum, thereby generating an opening at the upper end of the drum and enabling the material advancing means to discharge material advanced to the upper end of the drum through the opening.

7. The blender according to claim 6, wherein the drum is rotatably mounted to rotate about said longitudinal axis, the power means including means for rotating the drum about the longitudinal axis thereof, thereby driving the means for advancing the received material, wherein the means for advancing the received material comprises helical wall means attached interiorly of the drum and extending the length of the drum and having a pitch with respect to a predetermined direction of rotation of the drum for advancing the received materials toward the upper end of the drum, and wherein the means for receiving material at the lower end of the drum is a material receiving hopper having a semi-cylindrical bottom for rotatably receiving the lower end of the drum, the lower end of the drum including bearing means disposed adjacent lower end at the outer surface of the drum for rotatably supporting the lower end of the drum against the semi-circular bottom of the hopper.

8. The blender according to claim 7, wherein the helical wall means comprises at least one annular helical wall attached interiorly to the drum and extending from an inner surface of the drum radially inward and having a height less than the radius of the drum, successive convolutions of the at least one helical wall defining pockets for receiving material and for advancing the received material toward the upper end of the drum in response to a predetermined rotation of the drum.

9. Apparatus for elevating and blending materials comprising:

an elongate, cylindrical drum having a material intake end at one end and a material discharge end a second, opposite end of the drum, means disposed interiorly of the drum and attached to an inner surface of the drum for advancing material from the intake end toward the discharge end and for blending the material in response to rotation of the drum in a predetermined direction about a longitudinal axis of the drum;

a frame for rotatably supporting the drum with the longitudinal axis of the drum at an incline, the material intake end in a lowermost position and the material discharge end in an uppermost position of the drum;

means for rotating the drum in the predetermined direction for advancing material from the lowermost intake end to the uppermost discharge end of the drum and for blending the material; and means, selectively movable between a discharge position and a blending position, for returning, when moved to the blending position, material within the drum from the uppermost end of the drum toward the intake end of the drum for continued blending of the returned material with material advancing toward the uppermost end of the drum in response to rotation of the drum in the predetermined direction, and for discharging, when moved to the discharge position, material from the uppermost end of the drum in response to rotation of the drum in the predetermined direction.

10. Apparatus according to claim 9, wherein the means disposed interiorly of the drum for advancing and blending the material comprises at least one annular helical wall attached to the inner surface of the drum and extending substantially the entire length of the drum, and a tube extending from an uppermost convolution of the at least on helical wall at the discharge end of the drum toward the lowermost intake end of the drum, the tube having an axial length to terminate at a distance intermediate the intake end and the discharge end of the drum, the tube having a diameter to occupy a space centrally within the annular space of the drum occupied by the at least one helical wall, the outer surface of the tube being attached to the radially innermost edge of the at least one helical wall, the tube including means, disposed along the length of the tube for transferring material between the annular space of the drum occupied by the at least one helical wall and the central space within the tube.

11. Apparatus according to claim 10, wherein the means for transferring material between the annular space of the drum and the central space within the tube comprises a plurality of apertures spaced axially along the tube, each of the apertures communicating with an upper end of a pocket formed between two adjacent convolutions of the at least one helical wall.

12. Apparatus according to claim 10, further comprising an intake hopper attached to the frame adjacent the intake end of the drum, the intake hopper comprising a semi-cylindrical hopper bottom, the intake end of the drum including means for rotatably supporting the intake end of the drum within the semi-cylindrical hopper bottom, the intake end of the drum comprising at least one intake port for transferring material from the intake hopper to an annular space at the intake end of the drum adjacent a lowermost convolution of the at least one helical wall.

13. Apparatus according to claim 12, further comprising means for weighing material contained within the drum and the hopper.

14. Apparatus according to claim 13, wherein the frame comprises forward and rear support members, and wherein the means for weighing material comprises a plurality of weigh cells distributed beneath the forward and rear support members of the frame for measuring changes in weight within the drum and the hopper in response to material being added to the hopper or material being discharged from the uppermost end of the drum.

15. Apparatus according to claim 12, wherein the at least one helical wall is a single helical wall and the at least one intake port is a single intake port for receiving material from the hopper on each revolution of the drum about the longitudinal axis.

16. Apparatus according to claim 9, wherein the returning and discharging means comprises an end cover disposed at the uppermost end of the drum and means for movably mounting the end cover to move between the blending position in peripheral contact with the uppermost end of the drum and in the discharge position spaced from the end of the drum.

17. Apparatus according to claim 16, wherein the end cover is slidably mounted to the discharge end of the drum to move axially of the drum between the blending and discharging positions and to rotate in accordance with the rotation of the drum.

18. A method of elevating and blending materials which comprises:

rotating an elongate cylindrical drum disposed at an incline and having respectively axially opposite lower and upper ends in a predetermined direction about a longitudinal axis of the drum;

feeding materials to be blended in response to the rotation of the drum in the predetermined direction into the lower end of the drum;

elevating the materials in response to the rotation of the drum in the predetermined direction by advancing the materials in an annular region within the drum from the lower end toward the upper end of the drum;

blending the materials within the drum in response to the rotation of the drum in the predetermined direction, the step of blending including transferring the materials at the upper end of the drum from the annular region of the drum into a central region of the drum, moving the transferred materials within the central region axially of the drum from the upper end toward the lower end, and distributing at least portions of the materials transferred from within the central region to the annular region along predetermined transfer points along the axial path of the materials toward the lower end of the drum; and then selectively discharging the materials at the upper end of the drum from the drum in response to the rotation of the drum in the predetermined direction.

19. The method according to claim 18, further comprising weighing the material being fed into the drum by measuring an increase of the weight of the drum and determining an increase in weight of the drum in response of materials being fed into the drum.

* * * * *